US005209625A

United States Patent [19]

Stieger

[11] Patent Number: 5,209,625

[45] **Date of Patent: * May 11, 1993**

[54] APPARATUS FOR ROUNDING AND CONVEYING ONWARDS SHEET-METAL BLANKS FOR CAN BODIES

[75] Inventor: Othmar Stieger, Kindhausen, Switzerland

[73] Assignee: Elpatronic AG, Zug, Switzerland

[ * ] Notice: The portion of the term of this patent subsequent to Jun. 9, 2009 has been disclaimed.

[21] Appl. No.: 872,097

[22] Filed: Apr. 21, 1992

Related U.S. Application Data

[63] Continuation of Ser. No. 557,935, Jul. 25, 1990, Pat. No. 5,120,177.

[30] Foreign Application Priority Data

Aug. 22, 1989 [CH] Switzerland ..... 3-044/89-4

[51] Int. Cl.[5] ..... B21D 5/12; B21D 51/26

[52] U.S. Cl. ..... 413/72; 198/736; 413/74

[58] Field of Search ..... 413/69, 70, 71, 72, 413/73, 74, 75, 76, 77; 198/736, 738, 747; 219/64, 79; 228/17.4, 149, 150

[56] References Cited

U.S. PATENT DOCUMENTS 1,628,928 5/1927 Taylor ..... 219/64
3,001,636 12/1958 Socke .
3,934,324 1/1976 Hess et al. .
4,160,892 7/1979 Opprecht et al. .
4,417,117 11/1983 Opprecht .
4,870,241 9/1989 Gysi .
4,915,562 4/1990 Opprecht et al. .

FOREIGN PATENT DOCUMENTS 0247598 5/1987 European Pat. Off. .
3330171 2/1984 Fed. Rep. of Germany .

*Primary Examiner*—Bruce M. Kisliuk
*Assistant Examiner*—Jack Lavinder
*Attorney, Agent, or Firm*—McCormick, Paulding & Huber

[57] ABSTRACT

A sheet-metal blank (10) can be moved through between first and second bending rolls (24, 25). Disposed behind the bending rolls (24, 25) in its direction of movement (12) is a deflecting member (28) by which the sheet-metal blank (10) can be deflected away from the first bending roll (24) and round the second bending roll (25) out of its original direction of movement (12). In order to catch the edge of the sheet-metal blank (10) which was leading in the original direction of movement (12), a catch ledge (29) is disposed at the side of the second bending roll (25) remote from the first bending roll (24) and at least substantially in the common plane of the axes of the two bending rolls (24, 25). The catch ledge (29) is a component of a guide rail (30) on which the rounded sheet-metal blank (10) is guided with its longitudinal edges lying close beside one another during a further axial movement. The guide rail (30) extends at least substantially over the whole length of the two bending rolls (24, 25) and is arranged in such a manner that it is encircled by the sheet-metal blank (10) during the bending of the blank.

2 Claims, 6 Drawing Sheets

APPARATUS FOR ROUNDING AND CONVEYING ONWARDS SHEET-METAL BLANKS FOR CAN BODIES

This is a continuation of co-pending application Ser. No. 07/557,935 filed on Jul. 25, 1990 now U.S. Pat. No. 5,120,177.

BACKGROUND OF THE INVENTION

The invention relates to an apparatus for rounding and conveying onwards sheet-metal blanks for can bodies, having first and second bending rolls, through between which a sheet-metal blank can be moved, a deflecting member which is disposed behind the bending rolls in the direction of movement of the sheet-metal blank and at which the sheet-metal blank can be deflected away from the first bending roll and round the second bending roll out of its original direction of movement, a catch ledge to catch the edge of the sheet-metal blank which is leading in the original direction of movement, at least one pair of conveying members for the axial onward movement of the rounded sheet-metal blank, and a guide rail along which the rounded sheet-metal blank is guided with its longitudinal edges close beside one another during its axial onward movement.

In an apparatus of this type known from DE 3330171 A1, each sheet-metal blank to be rounded travels in succession through a conveying station, a preliminary bending station and a bending station. Each of these stations comprises a pair of horizontal rolls disposed one above the other. In the preliminary bending station, pre-bending members are arranged behind the roll gap and ensure that the sheet is bent backwards and forwards in order to enter the bending station as free of stresses as possible. Disposed in front of the roll gap of the bending station are upper and lower guide members between which the sheet-metal blank is guided. Disposed behind the roll gap of the bending station is a deflection member which bends the sheet-meet blank round the lower bending roll. Formed at the underside of the lower guide member disposed in front of the roll gap of the bending station is a catch ledge of hook-shaped section which catches the edge of the rounded sheet-metal blank which was leading in the former direction of movement. As soon as the trailing edge of the sheet-metal blank has left the roll gap of the bending station, the sheet-metal blank is displaced axially by a pair of entrainment members as a result of which its former leading and trailing edges, which are now directed longitudinally in the new axial direction of movement, are each pushed into a groove in a guide rail of Z-shaped section. The guide rail begins at an axial spacing beyond the bending rolls and ends immediately in front of a pair of electrode rollers of a welding station in which the longitudinal edges of the sheet-metal blank are welded together. The entrainment members which push the sheet-metal blank away from the bending station into the guide rail of Z-shaped section are arranged in pairs on an endless conveyor chain. Extending along the guide rail is a further chain conveyor with entrainment members likewise arranged in pairs which push the sheet-metal blank further forwards until it is caught by the electrode rollers.

SUMMARY OF THE INVENTION

It is the object of the invention to design an apparatus for rounding and conveying onwards sheet-metal blanks for can bodies in a more space-saving manner than the known apparatus described.

According to the invention, starting from an apparatus of the type described at the beginning, the problem is solved in that the catch ledge is disposed at the side of the second bending roll remote from the first bending roll, at least approximately in the common plane of the axes of the two bending rolls and is a component of the guide rail which extends at least substantially over the whole length of the two bending rolls and which is arranged in such a manner that during the bending of the sheet-metal blank, it is encircled by the blank.

Thus the effect is achieved that already at the end of the rounding, the sheet-metal blank assumes a position which corresponds or at least comes very close to that which is necessary for subsequent joining of its longitudinal edges. Here it is assumed that the longitudinal edges will be joined to one another in the usual manner, for example by soldering, butt-welding by means of an energy beam or, in particular, by an electrical resistance welding process during which a mash seam is formed.

The guide rail, which according to the invention is disposed immediately by the bending rolls and preferably extends over their whole length, with its portion acting as a catch ledge guides both longitudinal edges of the rounded sheet-metal blank from the beginning during its axial displacement with an accuracy which, in the known apparatus of this type, is only achieved gradually at some distance axially behind the bending rolls when the longitudinal edges of the sheet-metal blank are guided completely in the grooves in the guide rail of Z-shaped section for example, which only begins after the bending station. Because of the guiding accuracy already achieved in the bending station, according to the invention a conventional apparatus for joining the longitudinal edges of the sheet-metal blank can be disposed at only a short axial distance from the bending rolls, for example an apparatus with a pair of electrode rollers by which the sheet-metal blank is grasped at its longitudinal edges when it has scarcely left the range of action of the bending rolls.

In a preferred form of embodiment of the invention, the guide rail is partially embedded in an electrode supporting arm of an electric resistance welding machine, which arm is likewise encircled by the sheet-metal blank during the bending of the latter.

The guide rail may appropriately be in alignment with a Z-rail in which the longitudinal edges of the sheet-metal blank are guided during its further axial movement.

It is further an advantage if the space provided for the rounding of the sheet-metal blank is defined by shells of which at least one is adjustable. It is true that, in general, the roll gap between the bending rolls can be so dimensioned and the deflecting member can be so arranged that the edges of the rounded sheet-metal blank which extend in the axial direction each come to lie of their own accord at opposite sides of the catch ledge without the sheet-metal blank having needed guiding by the shells. Since, however, it is not always possible to count on a sheet quality which always remains constant, for sheet thickness and hardness of the sheet-metal blanks may vary within certain limits, it is advisable to ensure, by the arrangement of shells according to the invention, that even sheets of varying quality assume their prescribed position in relation to the guide rail at the end of the rounding.

The conveying members provided for the further axial movement of the rounded sheet-metal blank may be disposed in known manner on an endless conveyor chain or a pair of such chains. Additional construction space is necessary for this, however, and above all, such chain conveyors cannot be accommodated in the desirable manner near to the catch ledge arranged according to the invention, along which the longitudinal edges of the rounded sheet-metal blank slide during its further axial movement.

It is therefore an advantage if, according to a further form of embodiment of the invention, the two conveying members are bars which extend along the guide rail one at each side of the catch ledge to be encircled jointly with this guide rail by the sheet-metal blank travelling through between the bending rolls, and can be pulled out of the sheet-metal blank counter to the direction of its further movement and spread apart behind it in order to entrain it during a subsequent forward movement. Thus, apart from a space-saving form of construction and time-saving mode of operation of the apparatus, the effect is achieved that the lines of action of the feed forces exerted on the sheet-metal blank by the conveying members are adjacent to the longitudinal edges of the sheet-metal blank and are thus only a short distance away from the lines of action of frictional forces from the catch ledge and/or the guide rail which have an impeding effect on the sheet-metal blank. Accordingly, the sheet-metal blank is exposed to only slight tilting moments during its further axial movement; this also contributes to the high guiding accuracy aimed at. The features described above are therefore an advantage even independently of the manner in which the sheet-metal blanks are rounded.

The last-mentioned form of embodiment may advantageously be further developed in that

- the two conveying members are pivotally mounted in a sliding carriage which can be reciprocated in the longitudinal direction of the guide rail,
- a rocker is also mounted on the carriage in such a manner that reciprocating movements of the carriage are converted into pivoting of the rocker, and
- disposed on the rocker are cams whereby pivotal movements of the conveying members towards and away from one another are controlled.

In this case, it is a further advantage if a push rod is provided on the carriage with spacing from the two conveying members and substantially parallel thereto, outside the space enclosed by the rounded sheet-metal blank, which push rod acts with a catch mounted thereon on the rear edge of the rounded sheet-metal blank in addition to the two conveying members and offset at an angle in relation to these. In this manner the feed forces necessary for the further axial movement of the rounded sheet-metal blank can be distributed even more uniformly.

Even if the feed forces are transmitted to the rounded sheet metal blank completely free of moments, the risk that two or more sheet-metal blanks being conveyed one behind the other may pile up, for example as a result of a disturbance in a following welding apparatus, cannot be completely ruled out. Therefore it is advisable to eliminate the risk of overloading of the conveying members according to the invention, which are necessarily slender, by driving the carriage through a crank mechanism which comprises a crank secured to a driven shaft and a connecting rod with two connecting-rod parts which are guided telescopically for displacement on one another and are connected to one another through a releasable device which disengages in the event of an overload.

The transfer of the sheet-metal blank, moved on axially by the apparatus according to the invention, to a following apparatus, for example a pair of electrode rollers, requires a precise adaptation of the transfer point and of the speeds of the moving components to the known devices. Therefore, even independently of the features described above, it is an advantage if the driven shaft is mounted axially offset in relation to a driving shaft and is connected to this through an articulated coupling mechanism.

The articulated coupling mechanism preferably comprises two cranks which are secured to the driving shaft and to the driven shaft respectively and are connected to one another by a coupling member of adjustable length. For the adjustment of the articulated coupling mechanism, the length of the coupling member may be variable for example.

BRIEF DESCRIPTION OF THE DRAWINGS

One example of embodiment of the invention is explained with further details below with reference to the diagrammatic drawings. In these.

DESCRIPTION OF THE PREFERRED EMBODIMENTS

Figure 1:
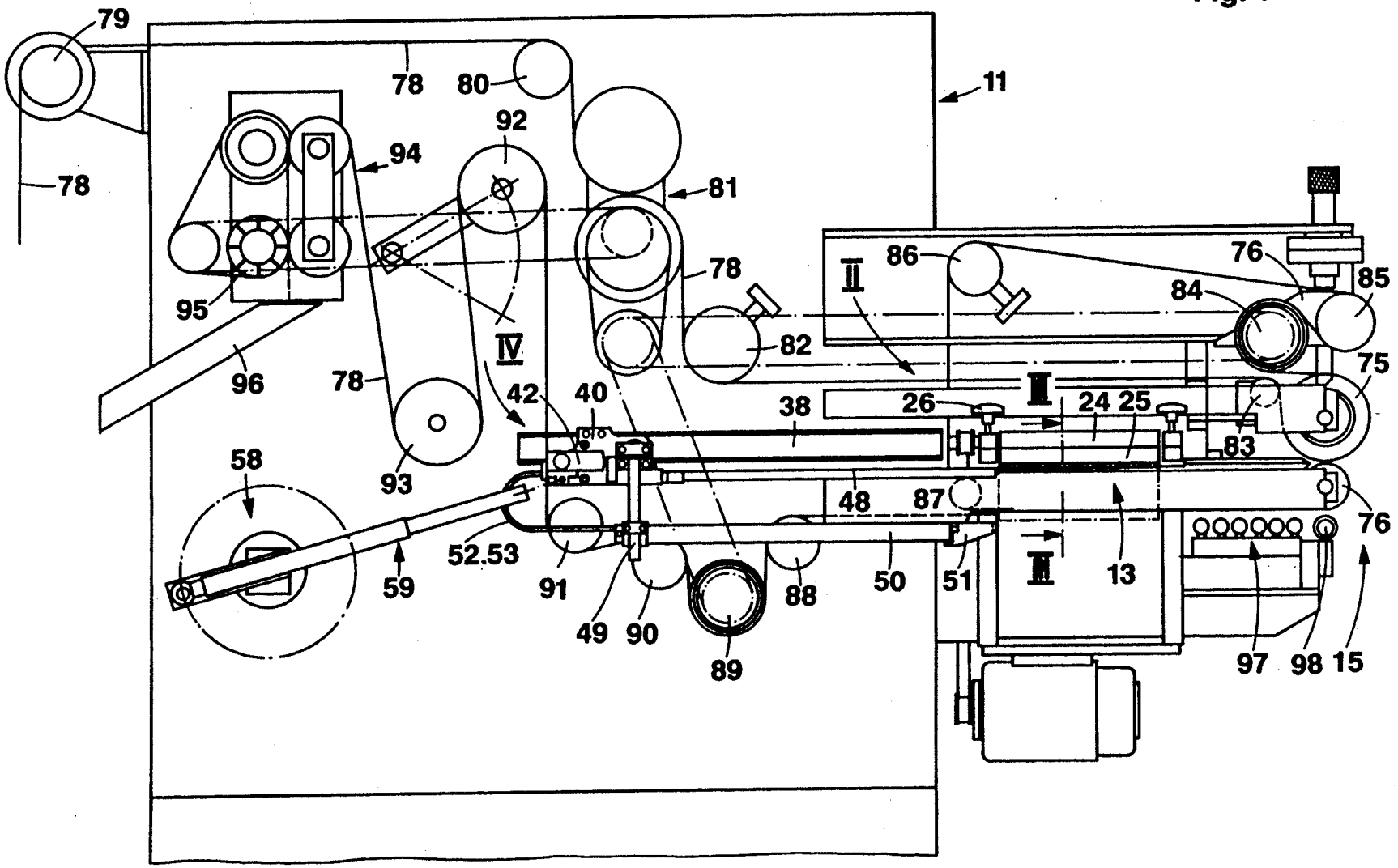
FIG. 1 shows a side view of a machine for the electrical resistance mash-seam welding of the longitudinal edges of can bodies.

With the machine illustrated, plane sheet-metal blanks 10 are rounded cylindrically and welded at their edges parallel to the cylinder axis. The devices necessary for these operations are disposed on a common machine frame 11. According to FIG. 2, the sheet-metal blanks 10, coming from an unstacking device (not illustrated), are fed in a horizontal direction of movement 12 to a rounding station 13 and leave this, rounded, in a likewise horizontal direction of movement 14, which forms a right-angle with the original direction of movement 12, and are fed to a welding station 15.

Figure 2:
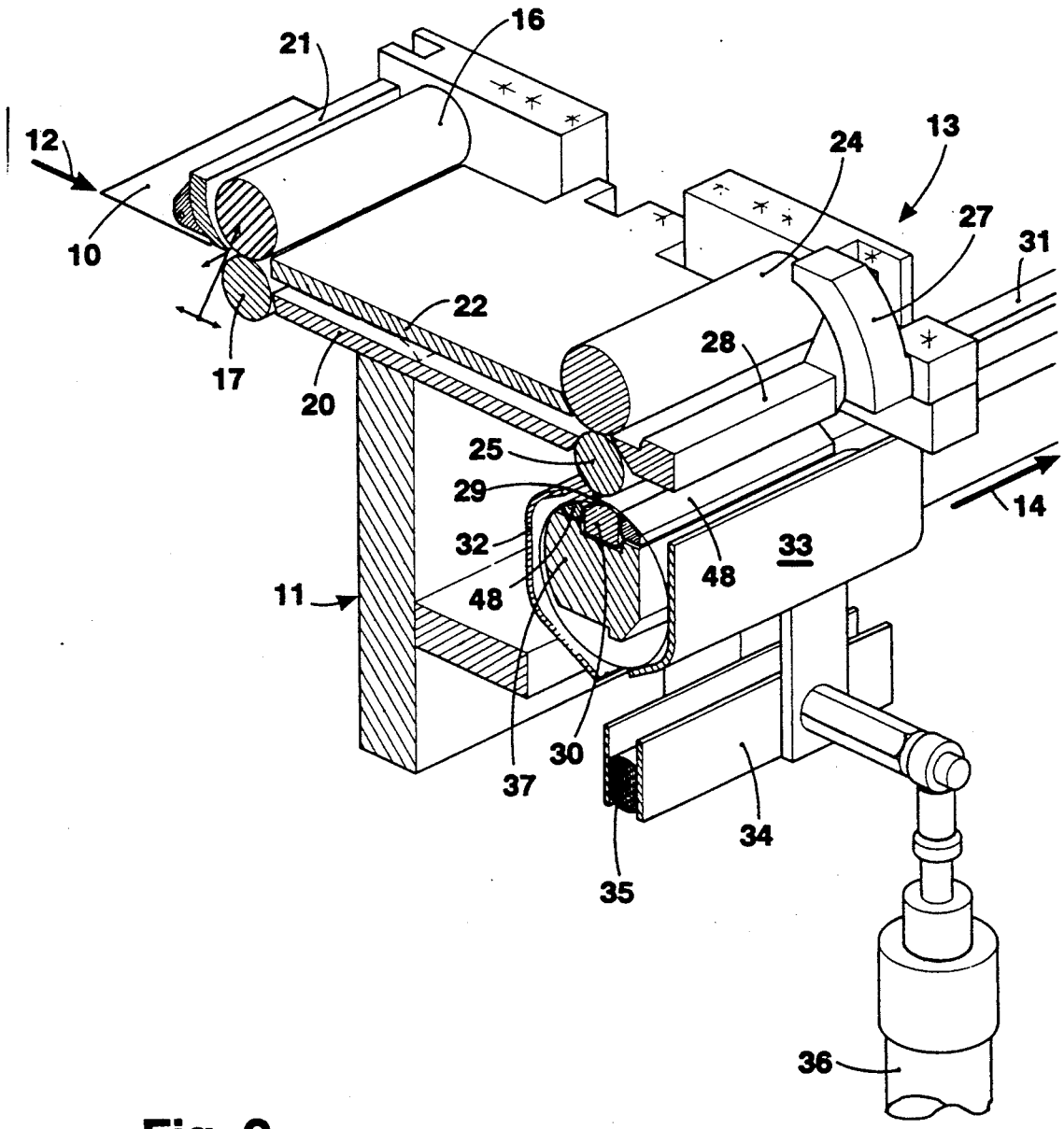
FIG. 2 shows an oblique view of a sub-assembly in the region II in FIG. 1.

The rounding station 13 includes a pair of conveying rolls 16 and 17 which extend horizontally and are arranged vertically one above the other and which can be driven jointly in order to convey one sheet-metal blank 10 at a time in the direction of movement 12 through an adjustable roll gap formed between them. A table 20 follows horizontally on from the lower conveying roll 17. Disposed in fromt of the conveying rolls 16 and 17 is a pre-bending member 21 which, in a vertical section as shown in FIG. 2, has a section which becomes narrower in the form of a wedge in the direction towards the roll gap between the conveying rolls 16 and 17.

The pre-bending member 21 is pivotable about an axis parallel to the conveying rolls 16 and 17 and is steplessly adjustable; in addition, the horizontal spacing of the pre-bending member 21 from the gap between the conveying rolls 16 and 17 is adjustable.

Following on the conveying rolls 16 and 17 is a cover plate 22 which is arranged stationarily above the table 20 and is likewise horizontal. Bending rolls 24 and 25 extending horizontally are arranged vertically one above the other at the end of the cover plate 22 and of the table 20. The roll gap between the bending rolls 24 and 25 is adjustable.

The sheet-metal blank 10 which enters the roll gap between the conveying rolls 16 and 17 is urged downwards by the pre-bending member 21 so that it strikes with its leading edge against the lower conveying roll 17. During the further movement in the direction 12 caused by the conveying rolls 16 and 17, the sheet-metal blank 10, with the exception of its leading edge region, again loses the bending imposed on it by the pre-bending member 21, as a result of the action of the table 20. Thus the greater part of the sheet-metal blank 10 is bent downwards and upwards again once in each case, as a result of which internal stresses are reduced. On the way from the conveying rolls 16 and 17 to the bending rolls 24 and 25, the sheet-metal blank 10 is guided between table 20 and cover plate 22. Before the conveying rolls 16 and 17 release the trailing edge region of the sheet-metal blank 10, its front edge region, which has remained curved downwards, is gripped by the bending rolls 24 and 25.

Disposed behind the bending rolls 24 and 25 is a guide 27 which is curved in arcuate shape round the narrowest part of the gap between the bending rolls 24 and 25 and carries a correspondingly arcuately adjustable deflecting member 28. The deflecting member 28 is so arranged that it bends the sheet-metal blank 10 which is moving through between the bending rolls 24 and 25, and the leading edge region of which is already bent down for the said reasons, as a whole in the same direction as the leading edge region, in the example illustrated downwards, that is to say away from the upper bending roll 24.

Disposed immediately below the lower bending roll 25, almost touching it, is a catch ledge 29 which extends over the whole length of the two bending rolls 24, 25 and is constructed in the form of a component of a guide rail 30 which is adjustable in height. The guide rail 30 is in alignment with a so-called z-rail 31 which is usually present in electrical resistance welding machines for welding mash seams, this rail 31 having a Z-shaped cross-section and extending as far as the welding station 15.

Figure 3:
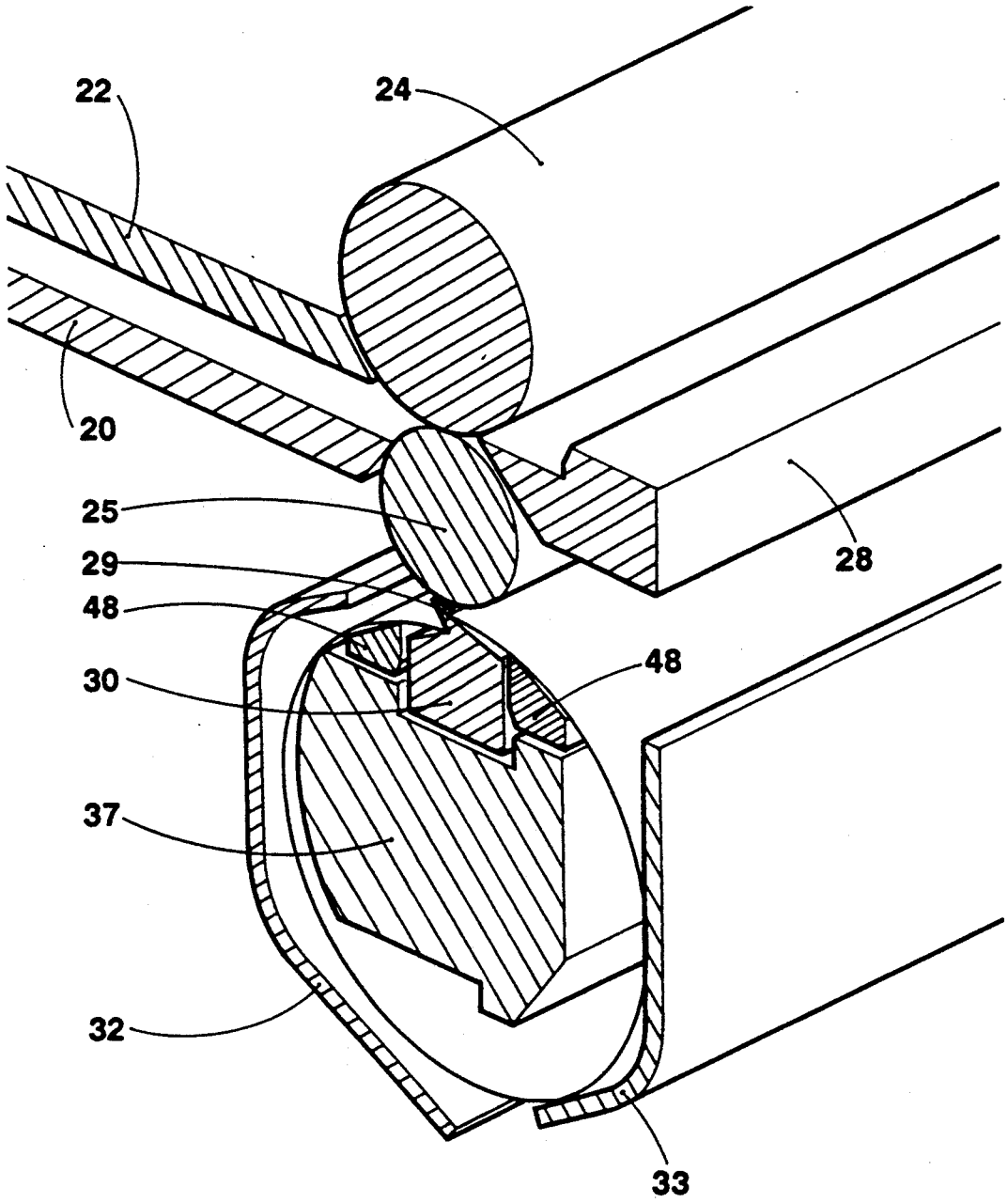
FIG. 3 shows an enlarged section through the same sub-assembly in the vertical plane III—III in FIG. 1.

The sheet-metal blank 10, which is bent by the bending rolls 24 and 25 circles round the guide rail 30 until it strikes with what was its leading edge in the former direction of movement 12 against the side of the catch ledge 29 which is on the left in FIGS. 2 and 3, as a result of which this edge is caught between the lower bending roll 25 and the guide rail 30. As soon as what was the trailing edge of the bent sheet-metal blank 10 in the previous direction of movement 12 is released by the bending rolls 24 and 25, it jumps into the gap between the lower bending roll 25 and the guide rail 30 and bears against the side of the catch ledge 29 which is on the right in FIGS. 2 and 3.

The space which is required for the rounding of the sheet-metal blank 10 is surrounded by two shells 32 and 33. The shell 32 has a C-shaped cross-section and is mounted fixedly at the side of the catch ledge 29 and of the guide rail 30 which faces the conveying rolls 16 and 17 and is on the left of the rail in FIGS. 2 and 3; the shell 33 has an L-shaped cross-section, is secured to an adjustable supporting plate 34 and is arranged at the side of the catch ledge 29 and of the guide rail 30 remote from the conveying rolls 16 and 17. The supporting plate 34 is mounted in a hinge-like manner on an elastomer member 35 in the shape of a roller and is pivotable about this elastomer member by means of a piston-and-cylinder unit 36.

The lower portion of the cross-section of the guide rail 30 fits into an electrode supporting arm 37 which is secured to the machine frame 11, which extends in the direction of movement 14 towards the welding station 15 and which also carries the Z-rail 31. The rounded sheet-metal blank 10 surrounds the electrode supporting arm 37 with radial spacing so that it can be displaced along the guide rail 30 as far as the free end of the electrode supporting arm 37, which is on the right in FIG. 1, and can be moved away from it there.

Arranged parallel to the electrode supporting arm 37, in a vertical plane, is a plate-like conveying rail 38 on which a sliding carriage 40 can be reciprocated in and counter to the direction of movement 14 upon ball guides 39. Secured to the carriage 40 at right-angles to the conveying rail 38 is a horizontal pivot 41 on which a rocker 42 is mounted for pivoting up and down between stops 43 and 44. Two cams 45, which each control a lever 46 are formed on the rocker 42. The two levers 46 are each secured to one of two shafts 47 which are mounted on the carriage 40 parallel to one another and to the conveying rail 38 and each of which carries a slender, bar-shaped conveying member 48.

Figure 9:
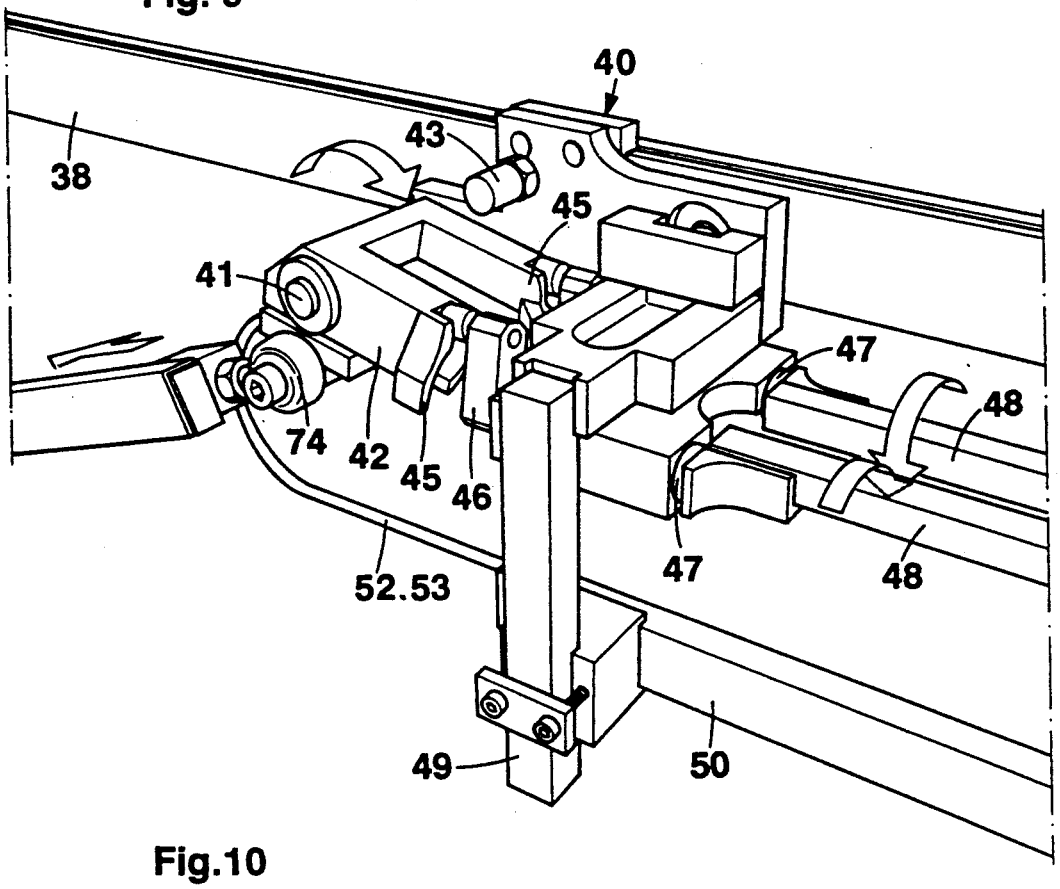
FIG. 9 shows an oblique view in the direction of the arrow IX in FIG. 4, in a first operating position.
Figure 10:
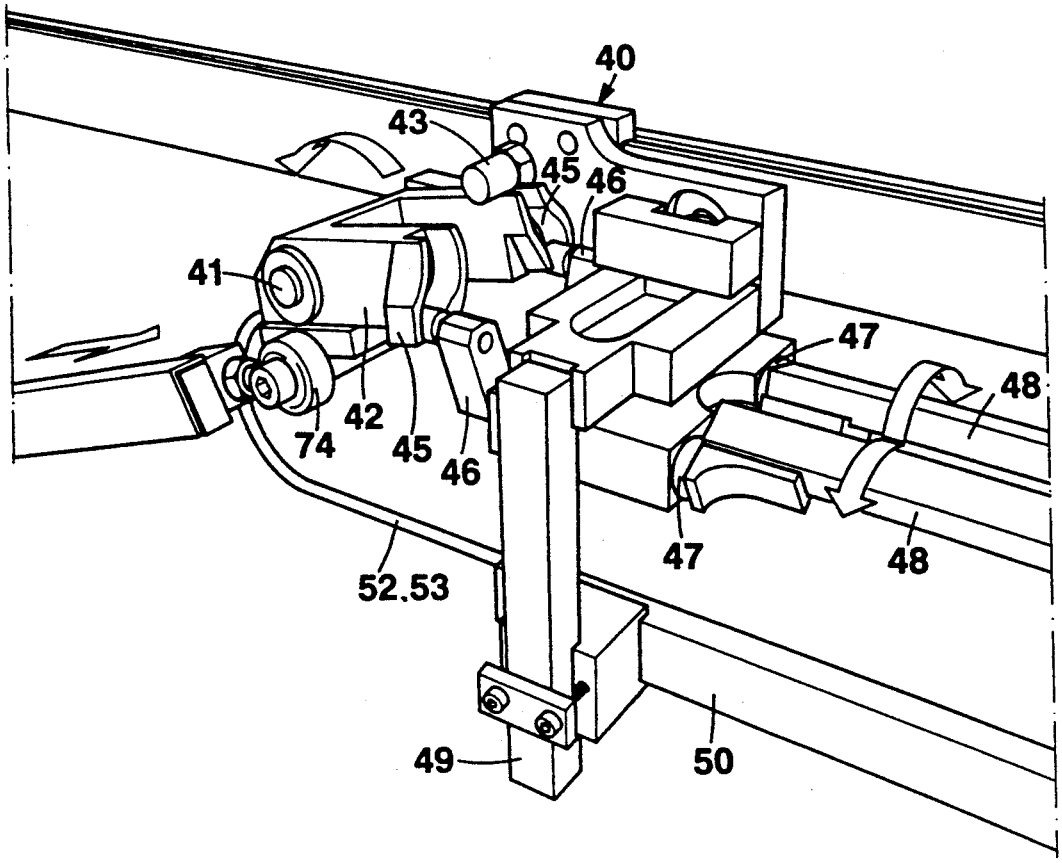
FIG. 10 shows an oblique view corresponding to FIG. 9 in a second operating position.

The conveying members 48 extend parallel to the conveying rail 38 and are each secured eccentrically to the associated shaft 47 so that the spacing between them is varied as the shafts 47 are turned by pivoting the levers 46 secured to them. In FIGS. 2, 3 and 9, the two conveying members 48 are represented in a position of rest in which they are arranged radially inside the rounded sheet-metal blank 10 and can be pulled out of the rounded sheet-metal blank 10, towards the rear, counter to the direction of movement 14, by a backward movement of the carriage 40. In FIG. 10, the conveying members 48 are represented in a working position in which, during the next forward stroke of the carriage 40 in the direction of movement 14, they strike against the circular edge of the rounded sheet-metal blank 10 which is to the rear in relation to this direction and push the sheet-metal blank forwards.

Secured to the carriage 40 is a vertical support 49 to which a push rod 50, parallel to the conveying members 48, is clamped in a height-adjustable manner. With a given diameter of the rounded sheet-metal blank 10, the push rod 50 is adjusted so that it can be moved past the outside of the rounded blank without touching it. A latch 51 is mounted on the front end of the push rod 50.

Figure 6:
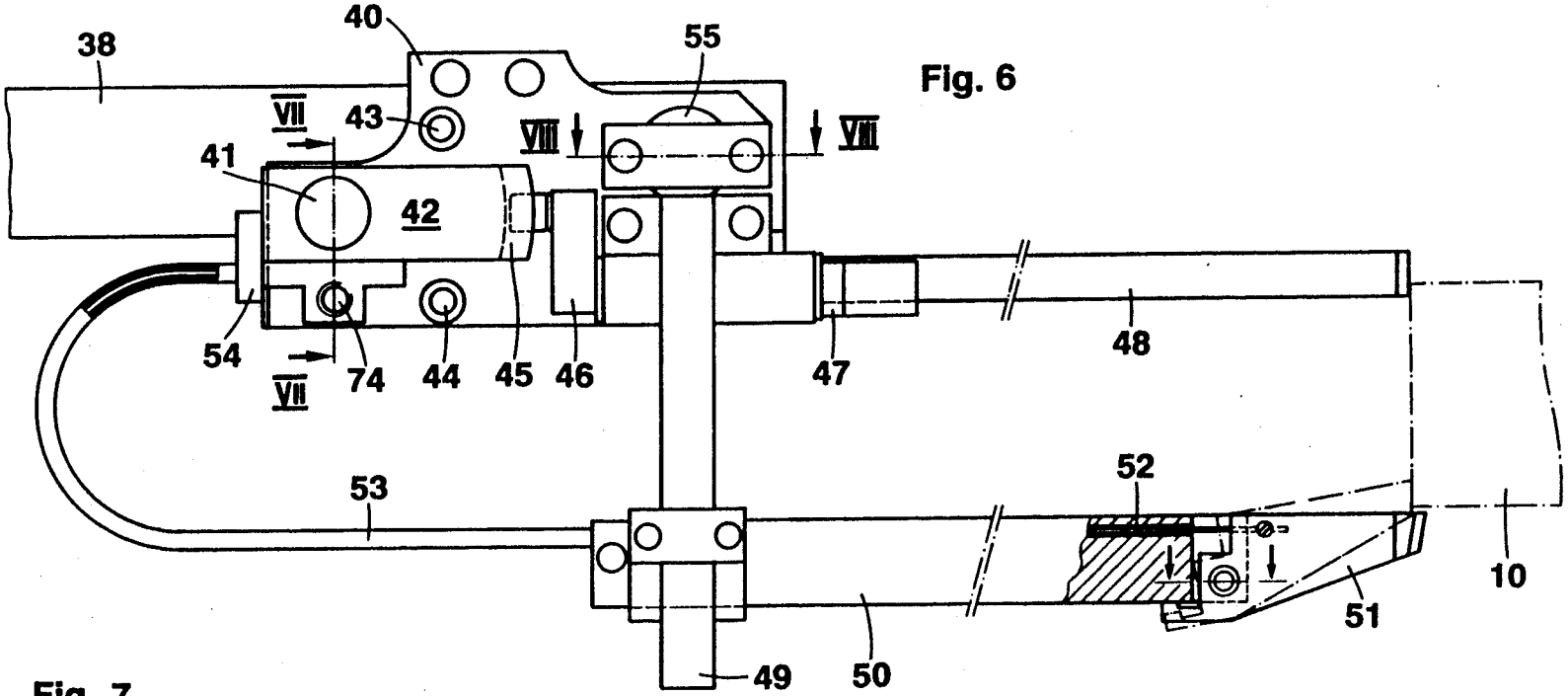
FIG. 6 shows the side view in the direction of the arrow VI in FIG. 4.
Figure 8:
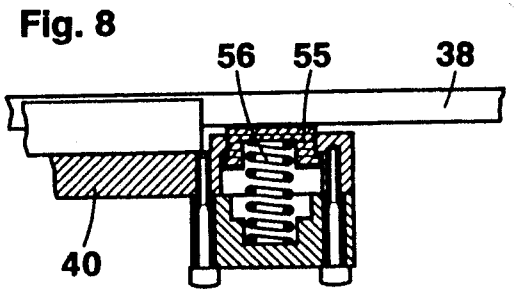
FIG. 8 shows the horizontal partial section VIII—VIII in FIG. 6.
Figure 7:
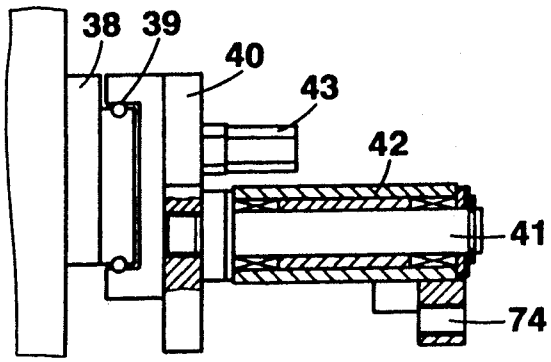
FIG. 7 shows the vertical partial section VII—VII in FIG. 6.

This catch is represented in FIG. 6 in full lines in its position of rest and in chain lines in its working position. In the position of rest, the latch 51 no more touches the rounded sheet-metal blank 10 during the backward stroke of the carriage 40 than does the push rod 50 itself. During the forward stroke of the carriage 40, however, the latch 51 strikes against the rear edge of the rounded sheet-metal blank 10 in order to push, jointly with the two conveying members 48, the rounded sheet-metal blank 10 out of the rounding station 13 into the welding station 15.

Figure 4:
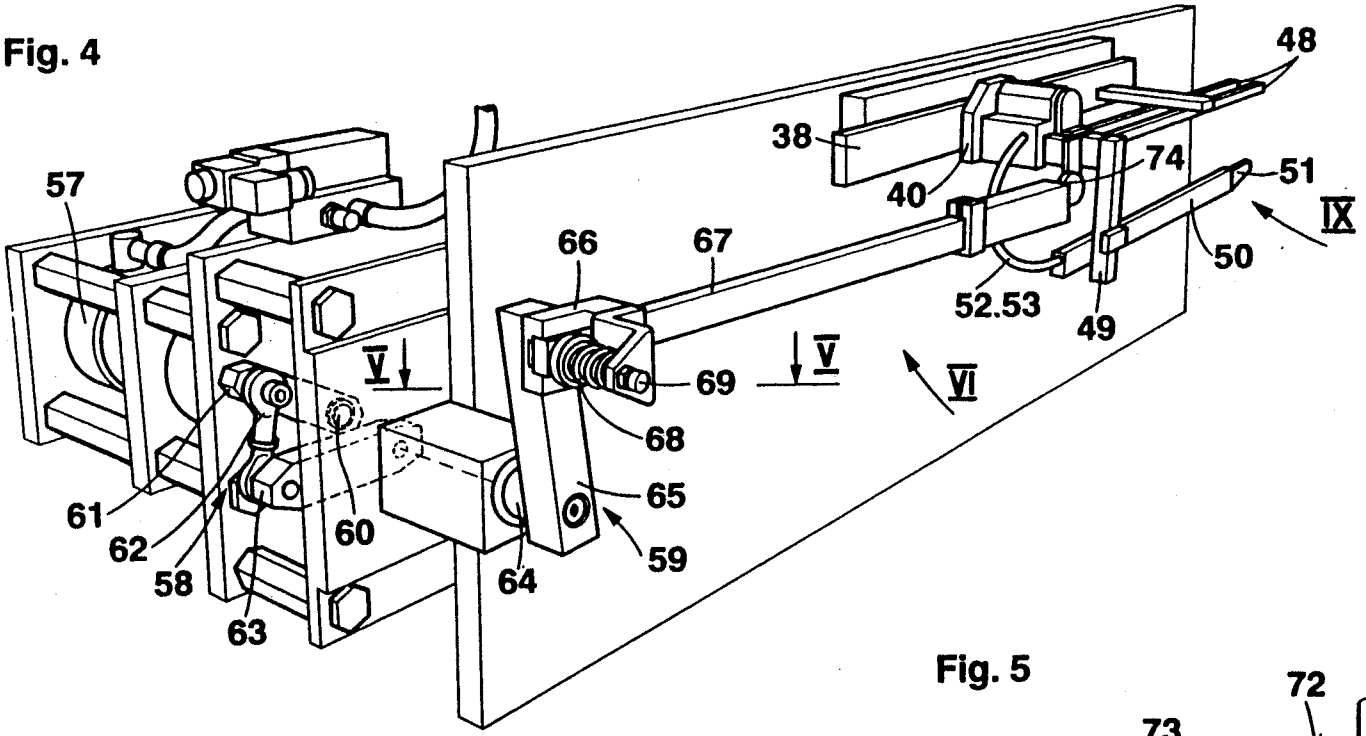
FIG. 4 shows an oblique view of the region IV in FIG. 1.
Figure 5:
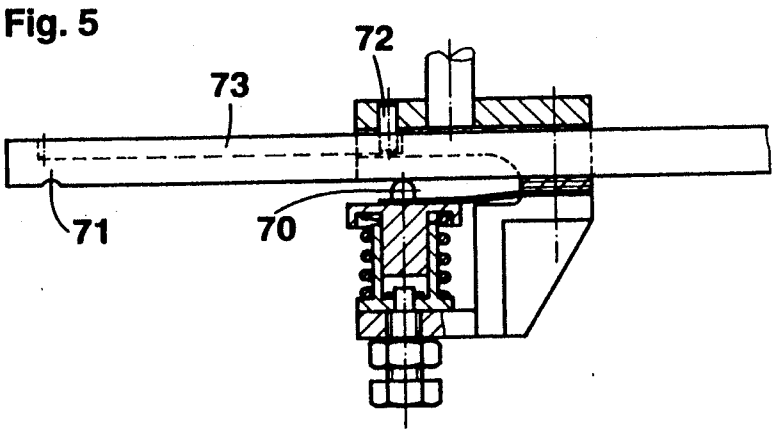
FIG. 5 shows the horizontal partial section V—V in FIG. 4.

Like the conveying members 48 and the push rod 50 with latch 51 in their position of rest, all the other parts which can be reciprocated with the carriage 40 are arranged so that they do not hinder the rounding of the next sheet-metal blank 10 in the working sequence, during the backward stroke 40. Thus this next sheet-metal blank 10 can be rounded around the two conveying members 48 even during the backward movement of the carriage 40, while the push rod 50 remains outside the rounded member being formed. As soon as this is completely rounded, the front ends of the conveying members 48, which are on the right in FIGS. 4 and 6, and the latch 51 have reached a position behind the rear edge of this newly rounded sheet-metal blank, so that the direction of movement of the carriage 40 can be reversed and the new sheet-metal blank can be pushed forwards into the welding station 15, following the preceding sheet-metal blank without loss of time.

The latch 51, like the two conveying members 48 is controlled by pivotal movements of the rocker 41. For this purpose, the latch 51 is connected to the rocker 42 by a cable 52 which, together with a sheath 53 forms a Bowden cable. The sheath 53 is supported at the one end on an abutment 54 secured to the carriage 40 and at the other end on the rear end of the push rod 50.

The pivotal movements of the rocker 42 in relation to the carriage 40, which are necessary to control the conveying members 48 and the latch 51, are derived from the reciprocating movements of the carriage. For this purpose, a brake member 55 is guided in the carriage 40 for displacement towards the conveying rail 38 and is loaded by a spring 56 in such a manner that it has a continuous braking action on the carriage 40. The driving forces necessary for moving the carriage 40 are obtained from a motor 57 and are transmitted, through an articulated coupling mechanism 58 and a crank mechanism 59, into the rocker 42 in such a manner that they apply a torque about the pivot 41.

The articulated coupling mechanism 58 includes a driving shaft 60 which is rotated continuously or intermittently and which by a first crank 61 secured to it, through a coupling member 62, to a second crank 63 which is secured to a driven shaft 64 parallel to the driving shaft 60 with a spacing therefrom. In the example illustrated, the articulated coupling mechanism 58 is adjustable in that the length of the coupling member 62 is variable. Instead of this, or in addition thereto, the effective length of the crank 61 and/or of the crank 63 may be variable by articulation of the coupling member 62 on the crank 61 or 63 at a more or less great radial distance from the driving shaft 60 or the driven shaft 64.

The driven shaft 64, together with a further crank 65 secured to it, a connecting-rod guide 66 and a connecting rod 67 which is displaceable telescopically in this, form the crank mechanism 59. The connecting-rod guide 66 is articulated on the crank 65 and contains a spring 68 which is loaded by an adjusting screw 69 in such a manner that it urges a detent pin 70 with a predetermined force into a recess 71 in the connecting rod 67. In the event of overloading, the detent pin 70 is forced out of the recess 71 so that the connecting rod 67 can be displaced in relation to the connecting-rod guide 66 within limits which are determined by the fact that a pin 72, which engages in a longitudinal groove 73 in the connecting rod 67, is secured to the connecting-rod guide 66.

The end of the connecting rod 67 remote from the connecting-rod guide 66 is connected to the rocker 42 by a joint 74. The joint 74 is arranged with spacing parallel to the pivot 41 in such a manner that a force transmitted from the connecting rod 67 to the rocker 42 and directed forwards in the direction of movement 14 causes an upward pivoting of the rocker 42 as shown in FIG. 10, as a result of which, the conveying members 48 and the latch 51 come into their working position. On the other hand, if the connecting rod 67 transmits a force directed counter to the direction of movement 14 to the rocker 42, this is pivoted downwards so that the conveying members 48 and the latch 51 assume their position of rest as shown in FIGS. 6 and 9.

The welding station 15 is of conventional construction. Its main components are an upper electrode roller 75, which is mounted on a vertically movable electrode head 76, which is biased downwards, and a lower electrode roller 77 which is mounted on the front end of the electrode supporting arm 37, on the right in FIG. 1. Running over the electrode rollers 75 and 77 is an electrode wire 78 which is taken in the form of round wire from a storage container (not illustrated) and runs over guide rollers 79 and 80 with a wire brake arranged in between, and through a rolling device 81. From the rolling device 81, in which it is given a flat section, the electrode wire 78 runs over further guide rollers 82 and 83, wraps round the upper electrode roller 75, runs from there over guide rollers 84 to 87, wraps round the lower electrode roller 76 and from there continues on over guide rollers 88 to 93 to a withdrawal device 94 and a chopper 95 with which the electrode wire 78 is chopped into small pieces which are carried away through a channel 96.

In the short distance between the rounding station 13 and the welding station 15, each sheet-metal blank 10 is pushed by the two conveying members 48 and the latch 51 through a roller cage 97 and a ring of sizing rollers 98.

I claim:

1. Apparatus for rounding and conveying sheet-metal blanks for can bodies comprising: first and second bending rolls between which a sheet-metal blank can be moved and bent into a rounded sheet-metal blank, the rounded blank being stopped in its movement by a catch ledge adjacent the second roll with the rounded blank substantially encircling a guide rail along which the blank is moved axially onward, and at least one pair of conveying members for the axial onward movement of the rounded sheet-metal blank, characterized in that the pair of conveying members are a pair of bars which extend along the guide rail, one at each side of the guide rail in a first position in which the bars are encircled jointly with the guide rail by the rounded sheet-metal blank after the blank passes between the bending rolls, each of said bars being movable between the first position adjacent the guide rail and encircled by the rounded blank and a second position withdrawn from the encircling blank rearward of the blank with respect to the direction of onward blank movement and with each bar located behind the blank with one end of each bar adjacent to the rearward edge of the blank in order to entrain the blank and move the blank axially onward during a subsequent forward movement of the members.

2. Apparatus according to claim 1 wherein the bars forming the conveying members are mounted for rotation about axes extending longitudinally of the bars and parallel to the rail, said rotation occurring during a portion of the movement between the first position and the second position.

* * * * *